United States Patent [19]

Blaskowski et al.

[11] 4,158,552

[45] Jun. 19, 1979

[54] ENTRAINED FLOW COAL GASIFIER

[75] Inventors: Henry J. Blaskowski, West Simsbury; Arun K. Mehta, Bloomfield, both of Conn.

[73] Assignee: Combustion Engineering, Inc., Windsor, Conn.

[21] Appl. No.: 828,353

[22] Filed: Aug. 29, 1977

[51] Int. Cl.[2] ..... C10J 3/00

[52] U.S. Cl. ..... 48/210; 48/197 R; 48/203

[58] Field of Search ..... 48/210, 202, 203, 197 R, 48/76, 77, 62 R, 86 R, DIG. 2, DIG. 4; 110/28 R, 31; 122/5

[56] References Cited

U.S. PATENT DOCUMENTS

| | | | |
|---|---|---|---|
| 901,232 | 10/1908 | Eldred | 48/203 |
| 3,871,839 | 3/1975 | Moody | 48/197 R |
| 3,891,402 | 6/1975 | Nahas et al. | 48/197 R |
| 3,904,386 | 9/1975 | Graboski et al. | 48/210 |
| 3,920,417 | 11/1975 | Fernandes | 48/202 |
| 3,993,583 | 11/1976 | Seglin | 48/202 |
| 4,052,172 | 10/1977 | Shirakawa et al. | 48/210 |

OTHER PUBLICATIONS

Patterson, "The Combustion Engineering Coal Gasification Program", pp. 28–34 of Combustion Magazine, May 1976.

*Primary Examiner*—S. Leon Bashore
*Assistant Examiner*—George C. Yeung
*Attorney, Agent, or Firm*—Edward L. Kochey, Jr.

[57] ABSTRACT

An entrained flow coal gasifier wherein a high temperature product gas stream is essentially formed by burning char with air. Additional char, formed by partial gasification of coal, is added immediately thereafter to obtain the gasification reaction. Fresh coal is thereafter supplied in a lower temperature region thereby obtaining the volatile components driven off at a relatively low temperature.

4 Claims, 1 Drawing Figure

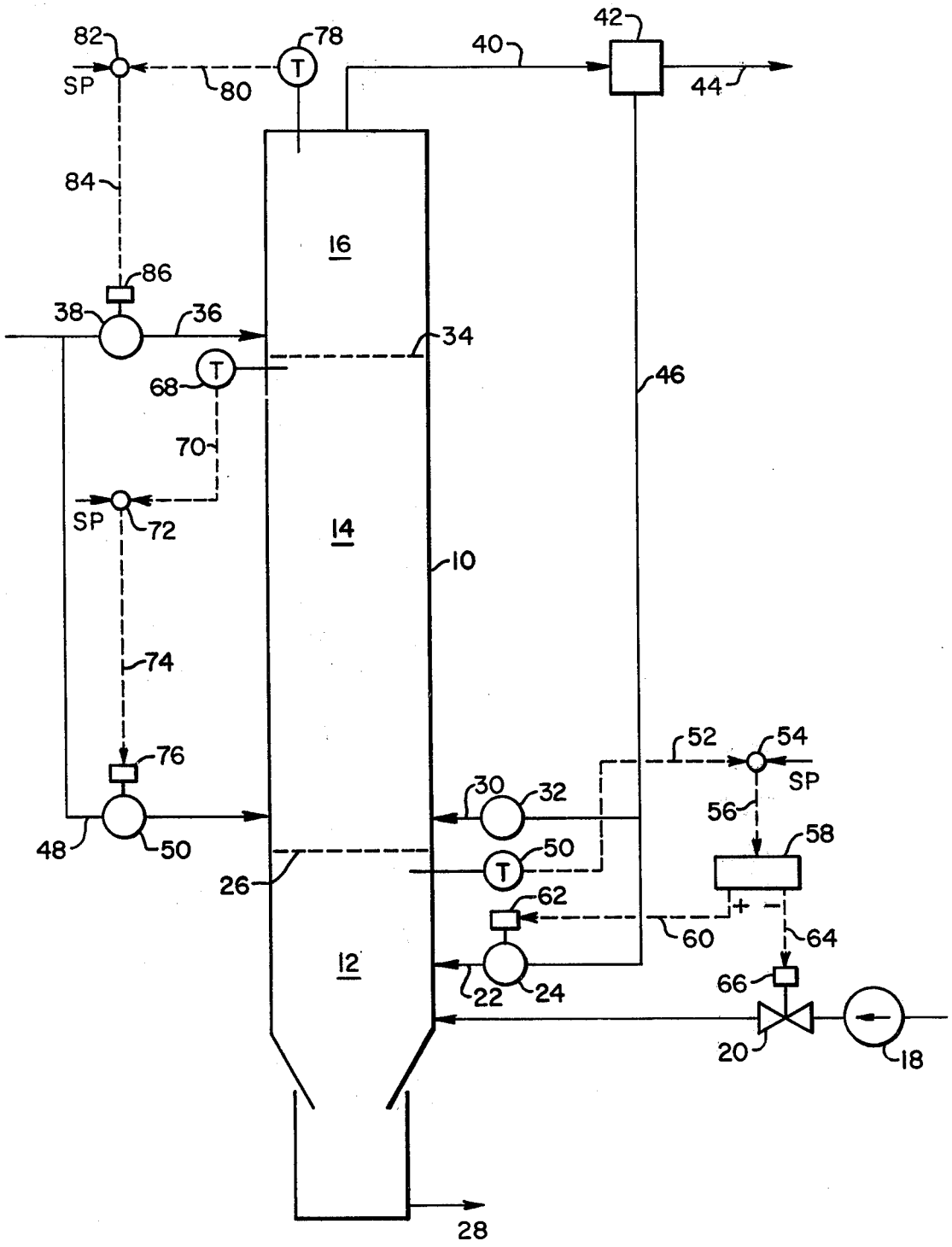
82
SP
80
78
T
40
42
44
84
16
86
38
36
34
68
T
46
70
SP
72
14
10
74
76
52
54
SP
30
32
56
48
50
58
50
T
26
62
+
−
60
64
12
66
22
24
20
18
28

ENTRAINED FLOW COAL GASIFIER

BACKGROUND OF THE INVENTION

This invention relates to entrained flow coal gasifiers and in particular to a method and apparatus for obtaining a higher heating value gas therefrom.

Gasification of coal is primarily the incomplete combustion of the coal. The maximum heating value is theoretically obtainable by maintaining a minimum air or oxygen to coal ratio. The ability to achieve this, however, is restrained due to the relatively high temperature level required to maintain the endothermic coal gasifying reactions.

The entrained flow gasification process involves the suspension of coal or char particles in a hot gas stream formed by combustion of fuel. These particles then flow concurrently with the product gas stream. Since the particles are suspended in the stream, problems with oiliness and stickiness of the particles during the gasification do not cause problems of stickiness in the flow of the coal.

In such a process, when the gas temperature drops to the range of 1700° to 2000° F. the rate of gasification of the carbon particles diminishes to such a point that there is no practical value continuing the gasification process. Some of the high temperature level of heat which was available from the initial combustion of the fuel has been used to drive off volatiles and, therefore, is not available for effectuating the gasification of the char particles. While there is still substantial heat content in the gas stream, it is not available for the coal gasification operation and can only be used to generate steam for some other useful purpose.

It is an object of the invention to more effectively utilize the heat available so as to increase the heating value of the gas produced.

SUMMARY OF THE INVENTION

In accordance with the invention a high temperature level of product gas stream is formed by burning primarily char with the existing air supply. Immediately thereafter additional char is introduced into the high temperature stream for gasification of these carbon particles. Thereafter, following the endothermic gasification reaction which cools the gases, the new fresh coal is introduced with this coal being devolatilized at relatively low temperature, thus utilizing low temperature heat. Entrained char particles are thereafter removed from the gas stream and reintroduced into the gasifier.

The low temperature devolatilization of the fresh coal is achieved by gas temperatures at a level which is insufficient to effectively continue the carbon gasification process. Accordingly, more of the available heat is used for the basic purpose of the coal gasification operation, which is of course to produce gas having the maximum reasonable heating value.

BRIEF DESCRIPTION OF THE DRAWING

The FIGURE is a schematic illustration of the coal gasifier arrangement.

DESCRIPTION OF THE PREFERRED EMBODIMENT

The coal gasifier indicated generally as 10 includes a combustion zone 12, a reductor 14 and a low temperature devolatilization zone 16. Oxygen is supplied to the combustion zone 12 by supplying air through forced draft fan 18 and regulating damper 20. The amount of this air is regulated in accordance with the desired output from the gasifier. Char which is comprised of carbon and ash is supplied through line 22 and regulated by feeder 24. The ratio of char and air is controlled to maintain a preselected temperature at the outlet 26 of the combustion zone.

The ratio is maintained in the combustion zone preferably on the fuel rich side of stoichiometric proportions. The maximum temperature (near stoichiometric) is desired consistant with the ability of materials forming the combustion zone to tolerate such temperatures. The temperature should be above 2800° F. to insure slagging of ash in the combustion zone and preferably about 3000° F. The ash contained in the char particles melts in the combustion zone and flows out through slag spout 28.

The product gas stream thus formed in the combustion zone passes upwardly into reductor section 14. At this location immediately downstream of the combustion zone additional char is added through line 30 and controlled by feeder 32. These char particles react endothermically with the combustion products leaving the combustion zone 12 forming carbon monoxide and hydrogen by reaction with carbon dioxide and water vapor contained in the gases exiting from the combustor. This reaction continues until the gases reach the outlet 34 of the reduction zone where the gas temperature is preferably 1700° to 2000° F. At these temperature levels the rate of the char gasification reaction is decreasing. Fresh coal is, therefore, added through line 36 and controlled by feeder 38.

This coal is added to the low temperature devolatilization zone 16 where the product gas stream is enriched and further cooled primarily because of the heating, and devolatilization of the incoming coal and reaction of the volatiles. At a temperature below 1400° F. and preferably about 1000° F. the gas products leave the low temperature devolatilization zone 16 flowing outwardly through gas outlet 40 to a particle separator 42. The optimum temperature is the minimum, with this being limited to above the temperature at which oils form for the particular coal being gasified. The gas stream continues through line 44 for removal of any contaminants in the gas and for use of the gas. Char particles are removed from the gas stream in the particle separator 42 and returned through line 46 to supply feeders 32 and 24.

The purpose of the combustion zone 12 is to supply the heat required for the process and to remove the ash from the system. While stoichiometric temperature is preferred, where this cannot be tolerated some of the gasification is permitted to occur in the combustor for the purpose of holding the temperature down. Since the char being introduced into the combustion zone will contain little volatile matter, it may be necessary to introduce supplementary fuel such as fresh coal, but only in sufficient amounts as required to maintain stability of ignition.

The recirculation of char particles to the reductor 14 maintains a relatively high char particle density as compared to a once through scheme and, therefore, can be expected to react relatively rapidly with the gas stream. The gas stream into which they are introduced is also at the maximum temperature level available, thereby favoring the char to gas reaction.

It is only after the gas temperatures in the reductor drops to a level at which the gasification is proceeding slowly that it is desirable to introduce the fresh coal for low temperature devolatilization purposes. The heat which is thereby used for devolatilization is the low level heat which would otherwise not be available for the gasification process.

With a particular coal, introduction of all of the coal into the low temperature devolatilizer may not be the optimum situation. A portion of the coal may be introduced to the combustor outlet for several reasons.

With a given air flow, and all the coal being gasified, the maximum heating value is obtained when the exit gas temperature is minimum, provided that the temperature reduction is due to the gasification process and not to heat exchange to other surfaces. It is essential to the invention that at least some of the fresh coal be introduced to the low temperature devolatilizing zone. Desirable limits on the amount may be established by either the char recirculating load or by the gasifier capacity.

With the low temperature devolatilization a very small amount of the char is gasified. It follows that this char must be recirculated to the gasifier, thereby tending toward a high char recirculation load.

On the other hand, with high temperature devolatilization conditions at the combustor outlet, a larger portion of the carbon content of any coal introduced at this location is immediately volatilized. Furthermore, the remaining carbon is partially gasified since it passes through the reductor zone. It is noted, however, that the temperature of the gas leaving the combustor is reduced because of the devolatilization of the coal, and this accordingly reduces the gas temperature available for the initial char gasification reactions.

With excessive amounts of coal to the low temperature devolatilizer recirculation of char may exceed the capacity of the char handling equipment, or produce excessive draft loss in the gasifier. This may be reduced by diverting a portion of the fresh coal to the reductor section.

The net effect of the offsetting phenomena occurring with introduction of a particular coal cannot be predicted at this time. Introduction of coal at the reduction zone inlet reduces the amount of char to be reacted, but also reduces the ability to react the char. With a fixed gasifier size and a particular coal an optimum utilization of the volume is expected with a fixed ratio of coal at the low temperature and high temperature sections. This ratio must be determined by experiment.

If the desired limit on introduction of fuel to the low temperature devolatilizer is reached, a portion of the coal supply is diverted through line 48 and controlled by feeder 50 for introduction at the upstream end of the reductor 14. This is introduced immediately after the combustor and before introduction of the char.

One method of controlling such introduction involves regulating coal through feeder 50 to maintain a temperature at the reductor outlet 34 and regulating coal through feeder 38 to maintain temperature leaving the low temperature devolatilizer 16.

The method of regulating the ratio of recycled char and air to obtain a preselected temperature at the combustor outlet may be carried out by the control apparatus which is schematically illustrated. The temperature sensor 51 emits a control signal through control line 52 which is compared at set point 54 to the desired temperature signal. A control signal representing the error passes through control line 56 to ratio controller 58. One control signal passes through control line 60 to controller 62 which regulates the speed of feeder 24. Another control signal of the opposite direction passes through control lines 64 to controller 66 which regulates the flow of air.

The gas temperature leaving the reductor section 14 may be controlled by measuring the exit temperature with temperature sensor 68. A control signal passes through control line 70 and is compared with a desired temperature signal at set point 72. An error signal passes through line 74 to controller 76 which operates to vary the speed of feeder 50 to regulate the introduction of fresh coal into the reductor.

In a similar manner, the temperature leaving the low temperature devolatilization zone 16 is sensed by temperature sensor 78 which sends a control signal through control line 80. This signal is compared at set point 82 to the desired temperature signal with an error signal passing through line 84 to controller 86. This controller varies the speed of feeder 38 to regulate the amount of fuel introduced into the low temperature devolatilization zone.

What is claimed is:

1. A method of operating a cocurrent entrained flow gasifier comprising: supplying oxygen and char to a combustion zone, and burning said char, thereby producing a product gas stream; controlling the ratio of oxygen and char to produce a product gas stream temperature exceeding 2800° F. leaving said combustion zone; introducing additional char into said product gas stream at a location downstream of said combustion zone in a reducing zone, thereby gasifying at least a portion of said char in said product gas stream and endothermically cooling said gas stream to a temperature below 2000° F.; introducing fresh coal into said product gas stream in a low temperature devolatilization zone at a location downstream of said reduction zone and also downstream of any oxygen supply, whereby volatile components of said fresh coal are driven off and the product gas stream is further cooled; regulating the introduction of coal into said product gas stream in such an amount as to cool the product gas stream to a temperature less than 1400° F.; and removing unburnt char from said product gas stream for introduction into said combustion zone and reduction zone.

2. The method of claim 1 wherein the introduction of coal to said product gas stream is regulated in an amount as to cool the product gas stream to a temperature less than 1000° F.

3. The method of claim 1 wherein said gas stream is endothermically cooled to a temperature less than 1700° F.

4. The method of claim 1 wherein the ratio of oxygen and char to a combustion zone is maintained to obtain a fuel rich product gas stream exceeding 3000° F. leaving the combustion zone.

* * * * *